US011058938B1

(12) United States Patent
Rasmus

(10) Patent No.: US 11,058,938 B1
(45) Date of Patent: Jul. 13, 2021

(54) MOUTH GUARD

(71) Applicant: Andrew Rasmus, Henderson, NV (US)

(72) Inventor: Andrew Rasmus, Henderson, NV (US)

(73) Assignee: Andrew Rasmus, Las Vegas, NV (US)

( * ) Notice: Subject to any disclaimer, the term of this patent is extended or adjusted under 35 U.S.C. 154(b) by 564 days.

(21) Appl. No.: 15/819,566

(22) Filed: Nov. 21, 2017

Related U.S. Application Data

(60) Provisional application No. 62/425,116, filed on Nov. 22, 2016.

(51) Int. Cl.
*A63B 71/08* (2006.01)

(52) U.S. Cl.
CPC ..... *A63B 71/085* (2013.01)

(58) Field of Classification Search
CPC ..... A63B 71/085; A63B 2071/086; A63B 2071/088; A61F 5/566; A61F 5/56; A61F 2005/563; A61C 7/08; A61C 7/36; G09F 3/20; G09F 3/201; G09F 3/18; G09F 3/185
See application file for complete search history.

(56) References Cited

U.S. PATENT DOCUMENTS

| | | | | |
|---|---|---|---|---|
| 2,827,899 A * | 3/1958 | Domenico | A63B 71/085 128/862 |
| 5,406,963 A * | 4/1995 | Adell | A61C 9/0006 128/861 |
| 8,800,184 B1 * | 8/2014 | Lerman | G09F 21/02 40/586 |
| 2004/0154626 A1 * | 8/2004 | Washburn | A63B 71/085 128/861 |
| 2013/0081640 A1 * | 4/2013 | Herman | A63B 71/085 128/861 |

* cited by examiner

*Primary Examiner* — Ophelia A Hawthorne
*Assistant Examiner* — Camtu T Nguyen

(57) ABSTRACT

A mouth guard has an interchangeable faceplate, an internal cushioning skeletal structure in the form of an interlocking lattice structure of reinforcing ribs, and securing wedges for securing the mouth guard to the upper teeth of a user.

3 Claims, 14 Drawing Sheets

FIG.3
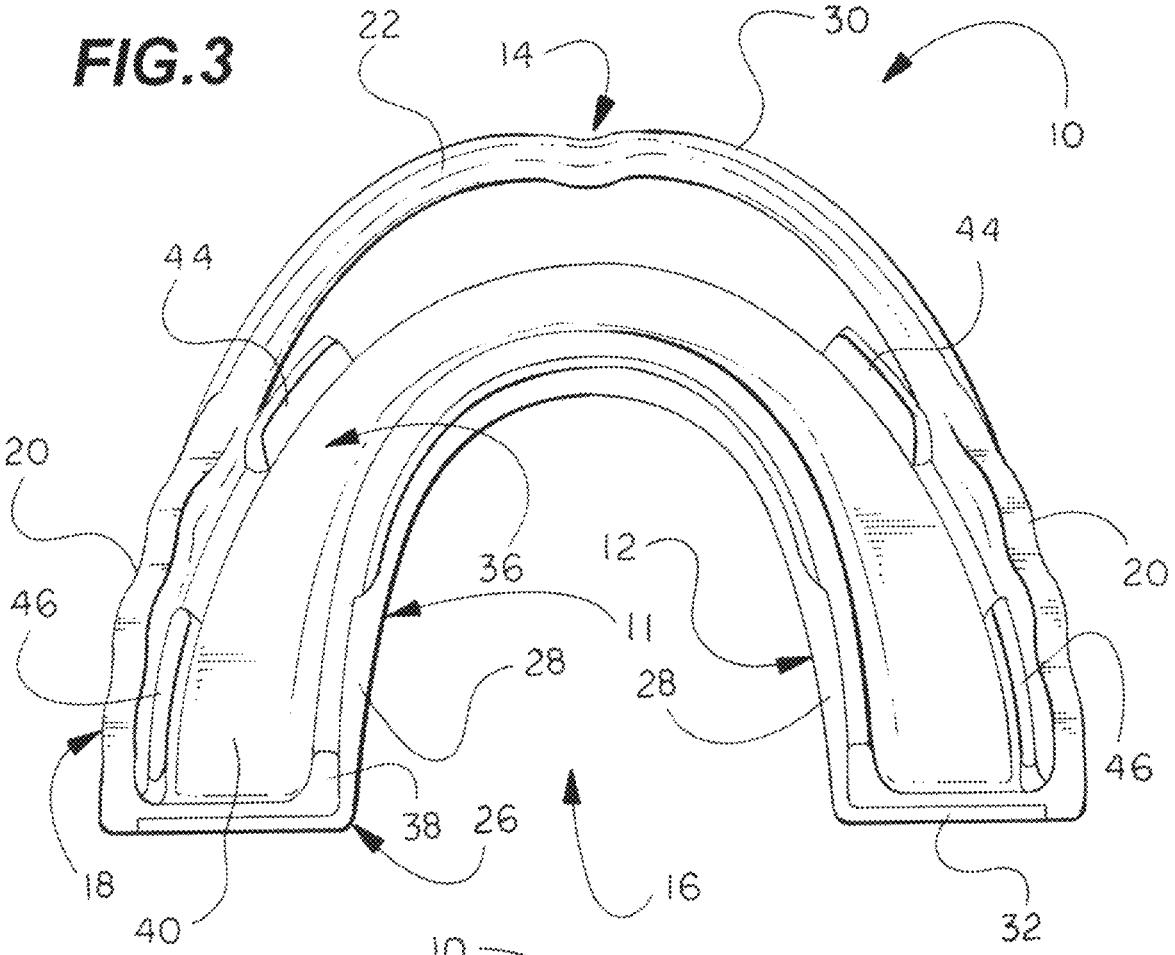
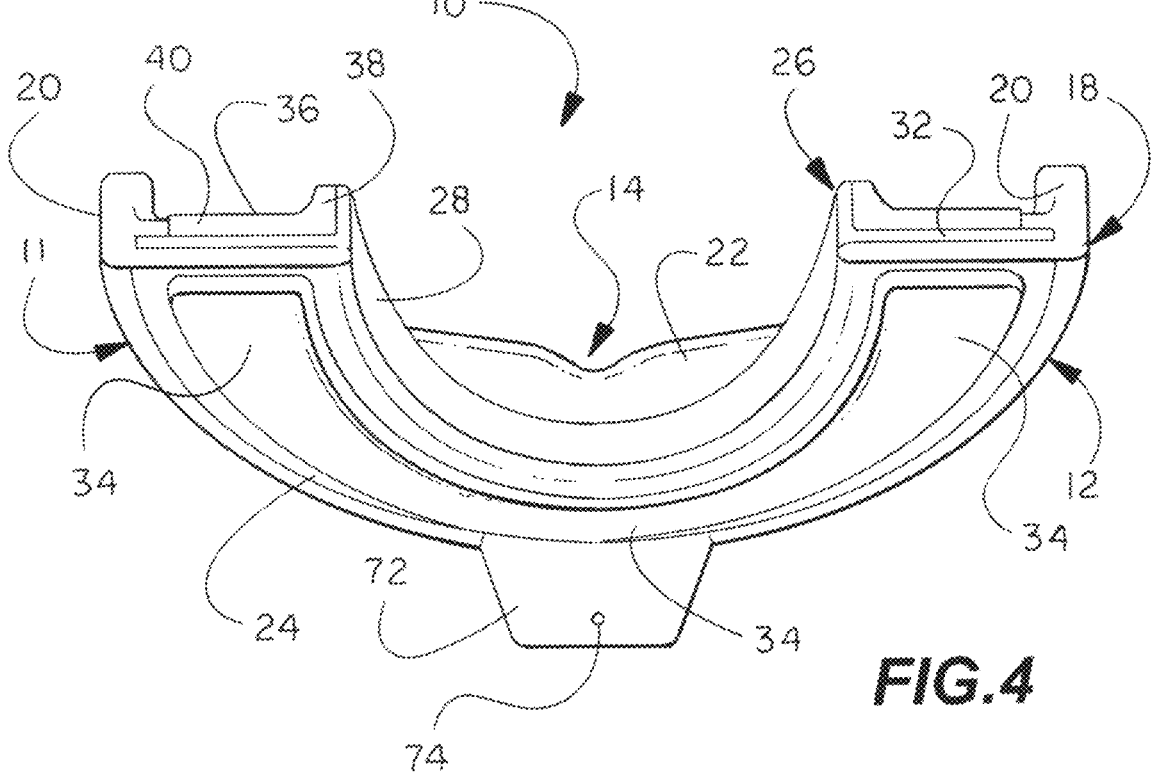
FIG.4

FIG.17A
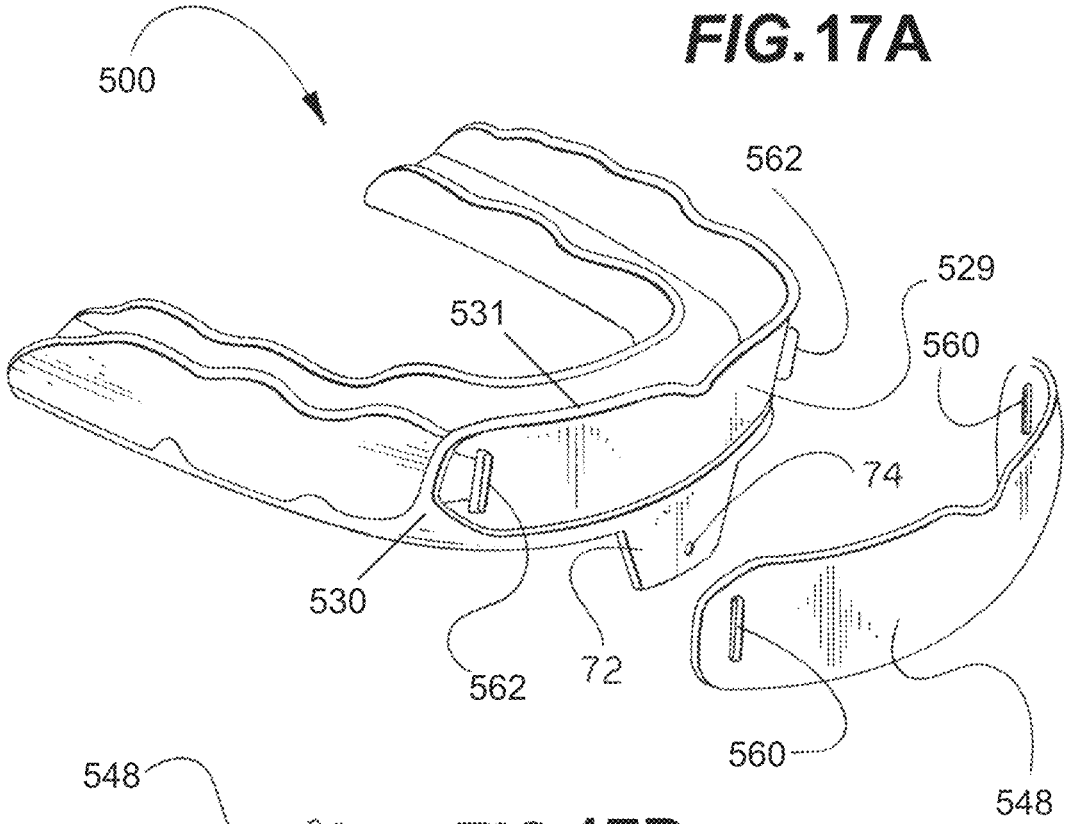
FIG.17D
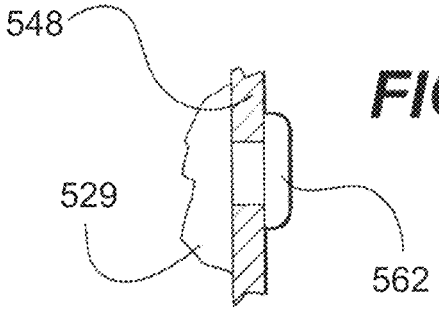
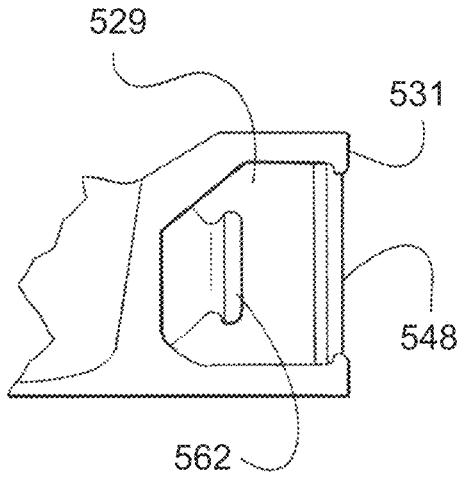
FIG.17B
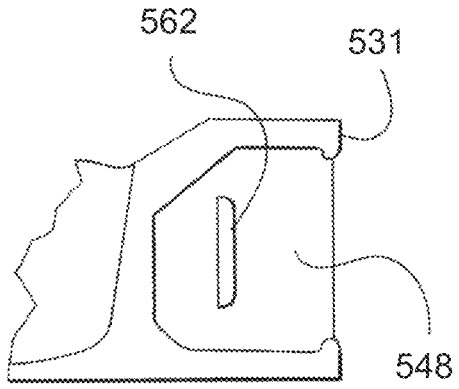
FIG.17C

MOUTH GUARD

CROSS REFERENCE TO RELATED PATENT APPLICATIONS

This invention claims priority from U.S. Provisional Patent Application Ser. No. 62/425,116, filed Nov. 22, 2016, which is hereby incorporated by reference.

FIELD OF THE INVENTION

This invention relates to a mouth guard, and more particularly to a mouth guard with an interchangeable faceplate, internal skeletal structure, and securing wedges.

BACKGROUND OF THE INVENTION

Mouth guards are known in the art as exemplified by U.S. Pat. Nos. 3,073,300, 3,247,844, 3,411,501, 4,495,945, 5,082,007, 5,353,810, 5,566,684, 6,109,266, 6,505,626, 6,675,807, US20110247635, US20120325224, US20130066236, US20130247923, US20140007884, and US20150040918.

SUMMARY OF THE INVENTION

The mouth guard of the present invention has an interchangeable faceplate, an internal skeletal structure, and securing wedges. Generally, the mouth guard of the present invention is U-shaped with a front, a left side extension, a right side extension, and an open back portion. The U-shaped mouth guard comprises a U-shaped skeletal structure, a U-shaped outer tray, a moldable U-shaped inner tray, and a moldable bottom pad.

The U-shaped skeletal structure has a skeletal base formed of a lattice of reinforcing ribs, a skeletal lingual side wall attached to the skeletal base, a skeletal labial side wall attached to the skeletal base, and a skeletal front panel attached to the skeletal base.

The U-shaped outer tray is molded around the skeletal structure. Particularly, the U-shaped outer tray has a labial side wall molded around the labial side wall of the skeletal structure, a front portion positioned behind and attached to the front panel of the skeletal structure, and a base attached to the underside of the lattice of reinforcing ribs. The base of the outer tray has a slot that exposes a portion of the overlying lattice of reinforcing ribs of the skeletal structure. The U-shaped outer tray also includes a pair of rear wedges protruding from the labial side wall and positioned adjacent to the open back portion of the mouth guard and a pair of forward wedges protruding from the labial side wall adjacent the front portion of the outer tray. The wedges engage the upper teeth of the user to hold the mouth guard in place.

The moldable U-shaped inner tray includes an inner tray base attached to an upper side of the lattice of reinforcing ribs of the skeletal structure and an inner tray lingual side wall attached to an inner side of the skeletal lingual side wall. The moldable bottom pad is attached to the underside of the lattice of reinforcing ribs through the slot in the base of the outer tray.

With respect to the interchangeable faceplate, the interchangeable faceplate is positioned in a front panel recess of the front panel of the skeletal structure. The interchangeable faceplate allows the user to personalize his or her mouth guard to whatever degree he or she wishes ranging from solid colors to names, jersey number, mascot icons, emoji's, user uploaded icons, etc. The faceplate is constructed of an antimicrobial and semi-flexible transparent plastic material. The material of the faceplate is a printable so that custom designs can be printed on the inside of the faceplate via a design tool.

Particularly, the interchangeable faceplates are removably attached to the front panel of the mouth guard in a variety of ways. In one embodiment, the interchangeable faceplate is attached to the front panel by means of the flexible recess edge extending around the front panel recess of the front panel of the skeletal structure. The peripheral edges of the faceplate are captured by a front panel groove formed between the flexible edge of the front panel and the front panel recess so that the faceplate is positioned in the front panel recess between the front panel and the flexible recess edge. Special tools are provided to flex the faceplate into the captured position and to flex the faceplate out of engagement of the flexible recess edge.

In another embodiment, the interchangeable faceplate is also attached to the front panel of the skeletal structure by means of snaps with at least one snap at each end of the interchangeable faceplate.

In yet another embodiment, the front panel of the skeletal structure of the mouth guard has a recess with a recess edge that has a slot on the top and discrete openings on the bottom. The faceplate slides through the slot at the top of the recess edge and tabs on the bottom of the faceplate engage the openings on the bottom of the recess edge.

In a further embodiment, the recess edge of the front panel recess has discrete openings along the top and bottom. The faceplate has matching tabs and is attached to the mouth guard by flexing the faceplate so that the tabs pass by the recess edge and engage the discrete openings in the recess edge.

With respect to the skeletal structure, the skeletal structure is a layer of injection molded material, like silicone or spongy plastic. The skeletal structure is positioned between the base of the U-shaped outer tray and the moldable inner tray. Generally, the skeletal structure is a lattice of ribs, for example, a series of interlocking Xs, a vertically section double helix (similar to a DNA strand), or other lattice-like embodiments that are contemplated by the present invention. The skeletal structure acts as a shock absorber reducing the amount of energy transferred by the bottom jaw moving toward the top jaw and vice versa during impacts. Studies show many concussions occurring during a sporting activity could be eliminated by cushioning the amount of energy transferred between the top and bottom jaws thereby adding an additional element to the user's safety.

With respect to the securing wedges, the securing wedges are molded into the U-shaped outer tray along the labial wall of the U-shaped outer tray. The securing wedges, like the U-shaped outer tray, are made of a heat resistant plastic that will not change shape or deform during the mouth guard fitting process. The securing wedges create contact points on both the front and rear face of the following teeth including the first and second premolars and the canine teeth. The securing wedges act as an anchor by creating a compression fit on the first and second premolars and the canine teeth. The securing wedges keep the mouth guard from falling out of the user's mouth during body impacts, hard breathing, running, and direct lateral facial impacts.

Further objects, features and advantages will become apparent upon consideration of the following detailed description of the invention when taken in conjunction with the drawings and the appended claims.

BRIEF DESCRIPTION OF THE DRAWINGS

FIG. 3 is a top plan view of the first embodiment of the mouth guard in accordance with the present invention.

FIG. 4 is a bottom perspective view of the first embodiment of the mouth guard in accordance with the present invention.

FIG. 17A is a front perspective view of a fifth embodiment of the mouth guard with faceplate fasteners in accordance with the present invention.

FIG. 17B is a detail view of the fifth embodiment of the mouth guard showing the faceplate fastener with the faceplate removed in accordance with the present invention.

FIG. 17C is a detail view of the fifth embodiment of the mouth guard showing the faceplate faster with the faceplate in place in accordance with the present invention.

FIG. 17D is a detail section view of the fifth embodiment of the mouth guard showing the faceplate fastener with fastener details in accordance with the present invention.

DETAILED DESCRIPTION OF THE PREFERRED EMBODIMENTS

Figure 1:
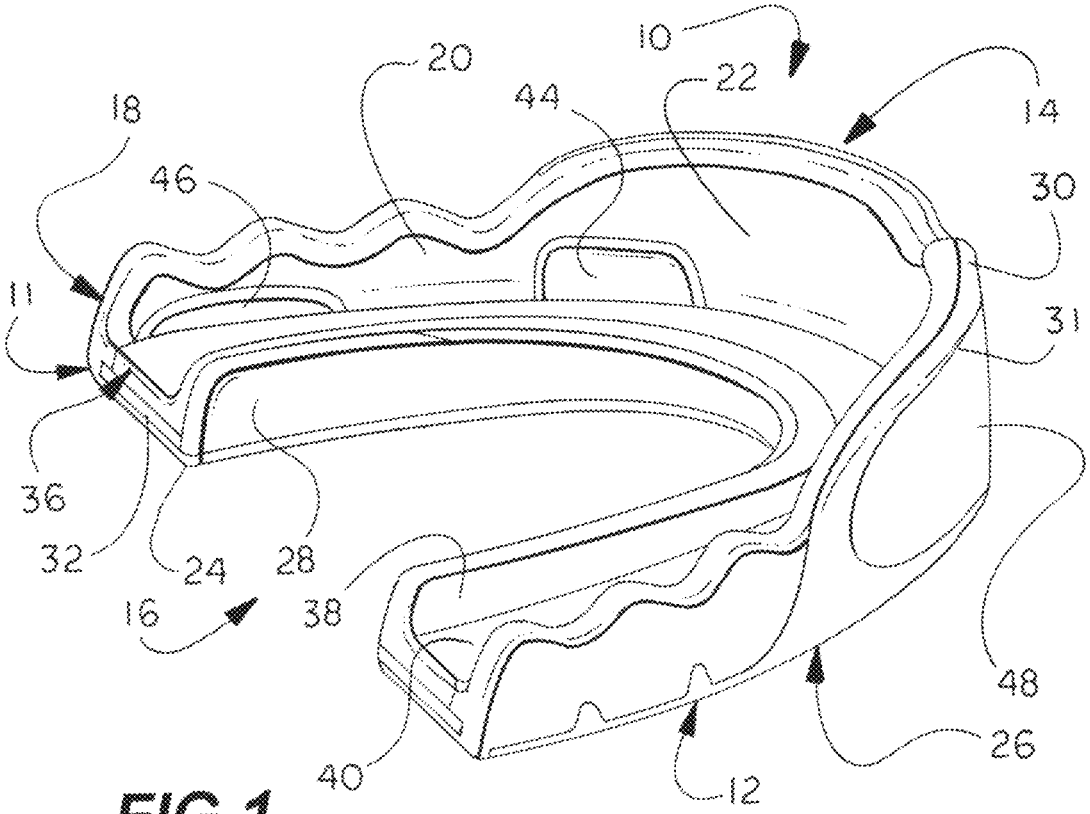
FIG. 1 is a perspective view of a first embodiment of a mouth guard in accordance with the present invention.
Figure 2:
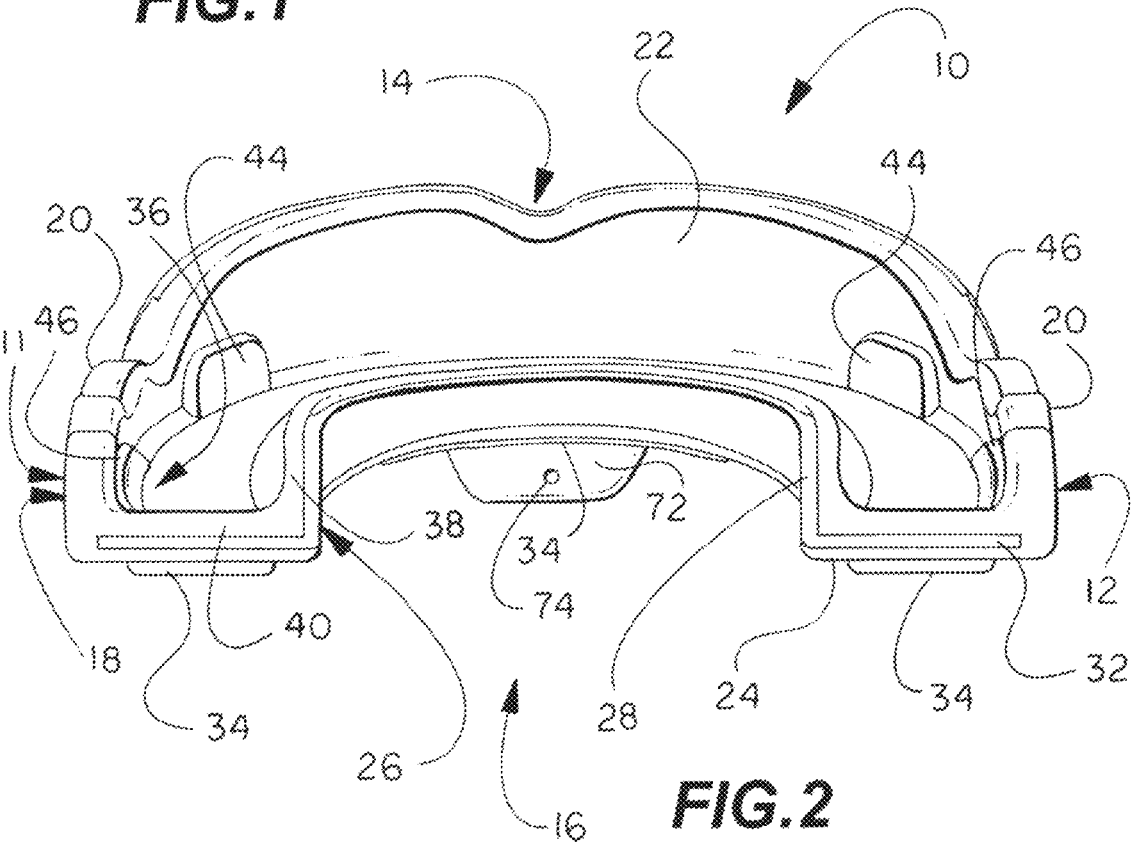
FIG. 2 is a back elevation view of the first embodiment of the mouth guard in accordance with the present invention.

A first embodiment of a mouth guard 10 in accordance with the present invention is illustrated in FIGS. 1-9. A U-shaped mouth guard 10 of the present invention is U-shaped with a front 14, a left side extension 11, a right side extension 12, and an open back portion 16. The U-shaped mouth guard 10 comprises a U-shaped skeletal structure 26, a U-shaped outer tray 12, a moldable inner tray 36, and a moldable bottom pad 34.

The U-shaped skeletal structure 26 comprises a base 32 comprising a lattice of reinforcing ribs 33, a lingual side wall 28 extending upward from the base 32, a labial side wall 27 extending upwardly from the base 32, and a front panel 30. The lattice of reinforcing ribs 33, for example, is shown as a series of interlocking Xs. Other lattice-like structures with reinforcing ribs and open spaces may be used, for example, a vertically section double helix (similar to a DNA strand). The lattice of reinforcing ribs 33 contributes to the bonding of the U-shaped outer tray 18, the moldable inner tray 36, and the moldable bottom pad 34 to the skeletal structure 26. The skeletal structure 24 also includes a securement tab 72 with an opening 74. The securement tab 72 extends downwardly from the front panel 30 of the skeletal structure 26. A cord or other securement means can be attached to the securement tab 72 by means of the opening 74.

Figure 25:
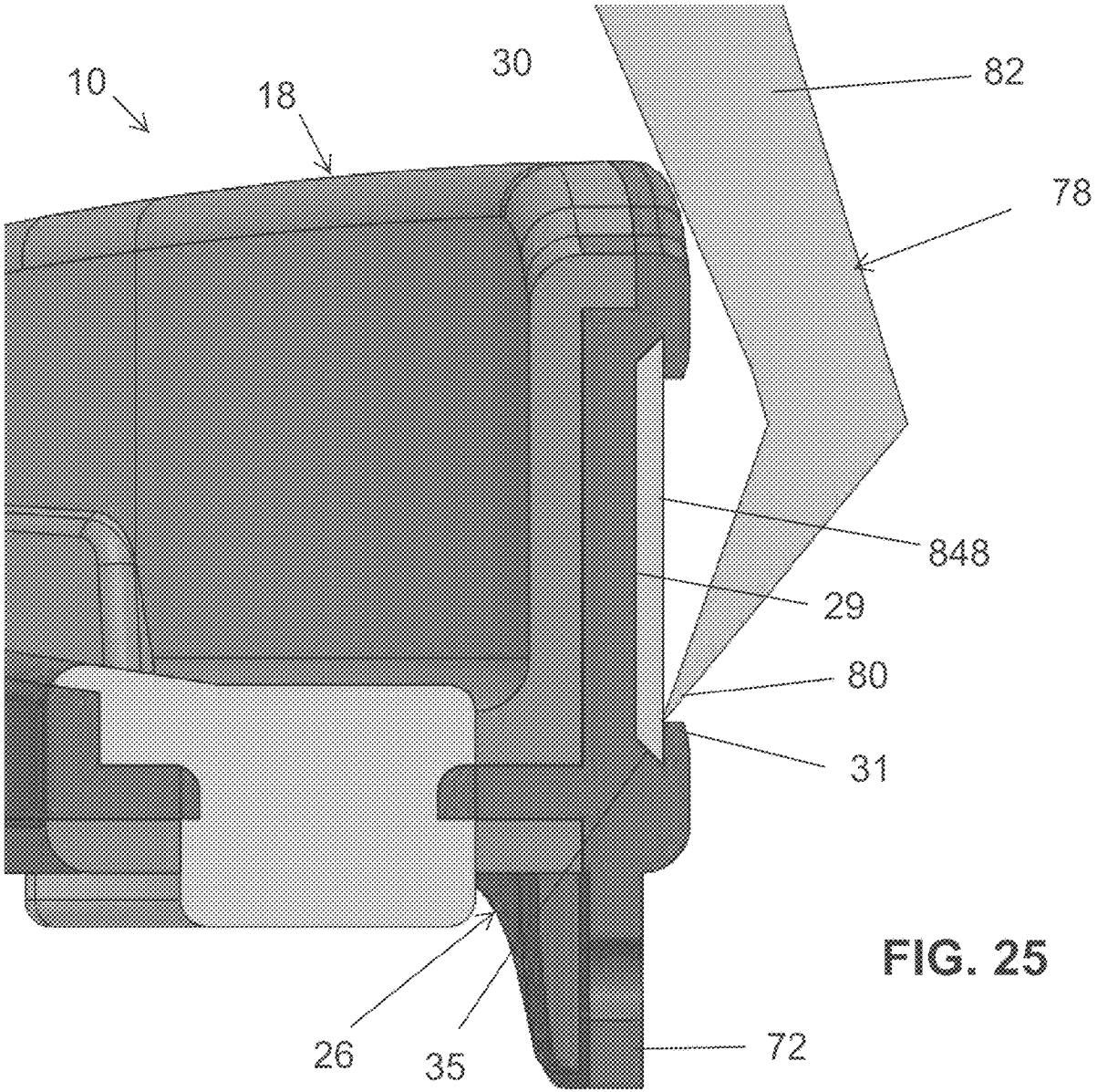
FIG. 25 is a section view of the first embodiment of the mouth guard without the removal openings in the faceplate along line 25-25 in accordance with the present invention.

The front panel 30 of the skeletal structure 26 includes a front panel recess 29 surrounded by a front panel recess edge 31. A front panel groove 35 is formed between the front panel recess 29 and the surrounding front panel recess edge 31 as best seen in FIG. 25. As will be described in greater detail below, the front panel recess 29 accommodates a removable faceplate 48 that is generally held in place in the front panel groove 35 by the front panel recess edge 31.

With respect to the skeletal structure 26, the skeletal structure 26 is an injection molded FDA grade thermoplastic polypropylene or polyethylene material. The skeletal structure 26 is positioned between the outer base 24 of the U-shaped outer tray 18 and the moldable inner tray 36. Generally, the skeletal structure 26 acts as a shock absorber reducing the amount of energy transferred by the bottom jaw moving toward the top jaw and vice versa during impacts. By varying the number and spacing of reinforcing ribs 33 in the lattice of the base 32, the degree of deformation can be adjusted. Studies show many concussions occurring during a sporting activity could be eliminated by cushioning the amount of energy transferred between the top and bottom jaws thereby adding an additional element to the athlete's safety.

Figure 8:
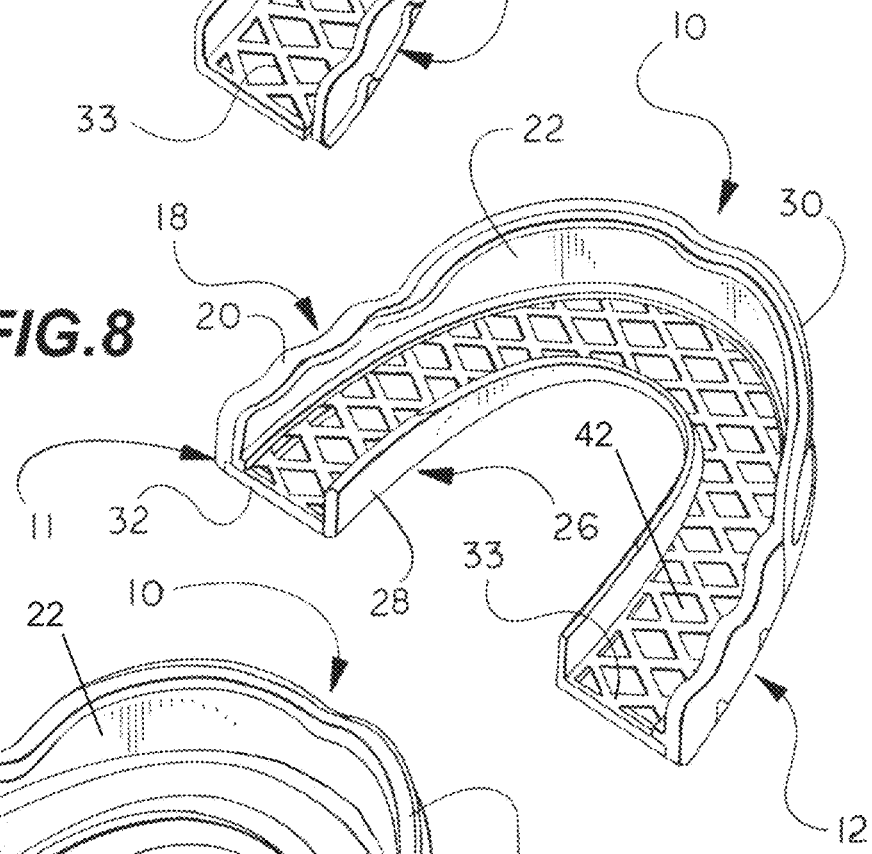
FIG. 8 is a top perspective view of the U-shaped skeletal portion and a U-shaped outer tray portion with a labial side wall and a front portion of the first embodiment of the mouth guard in accordance with the present invention.

The U-shaped outer tray 18 comprises an outer base 24, a labial side wall 20 extending upwardly from the outer base 24 and an outer front portion 22 extending upwardly from the outer base 24. The labial side wall 20 is molded over the labial side wall 27 of the skeletal structure 26. The front portion 22 of the U-shaped outer tray 18 is molded behind the front panel 30 of the skeletal structure 26 so that the front panel 30, front panel recess 29, and front panel recess edge 31 are exposed at the front 14 of the U-shaped mouth guard 10. The base 24 of the U-shaped outer tray 18 underlies the base 32 of the skeletal structure 26. The base 24 of the U-shaped outer tray 18 bonds to the lattice of reinforcing ribs 33 of the base 32 of the skeletal structure 26. As previously discuss, the open lattice construction of the lattice of reinforcing ribs 33 also contributes to the bonding between the skeletal structure 26 and the U-shaped outer tray 18. The base 24 of the U-shaped outer tray 18 also has a slot 42 extending along a majority of the length of the base 24. As shown in FIG. 8, the slot 42 exposes a portion of the lattice of reinforcing ribs 33.

The U-shaped outer tray 18 includes a pair of forward wedges 44 and a pair of rear wedges 46 on the inside of each of the labial side walls 20 of the U-shaped outer tray 18. The forward wedges 44 and the rear wedges 46 protrude from the inside of the labial side wall 20 and extend toward the base 24 of the U-shaped outer tray 18. The forward wedges 44 engage the user's canine teeth, and the rear wedges 46 engage the user's rear molars. The pressure created by the wedges 44 and 46 against the user's upper teeth tend to hold the mouthpiece 10 in place during impact or circumstances where the mouth is open.

The material for the U-shaped outer tray 18 is a relatively rigid plastic material that establishes the U-shape for the mouthpiece 10. The outer tray 18 is an injection molded FDA grade thermoplastic polypropylene and polyethylene material.

The moldable inner tray 36 comprises a moldable base 40 and an upwardly extending moldable lingual side wall 38. The moldable inner tray 36 is position on the base 32 of the U-shaped skeletal structure 26. The moldable base 40 of the moldable inner tray 36 rests on and is attached to the base 32 of the U-shaped skeletal structure 26. Again, the lattice of reinforcing ribs 33 of the base 32 assists in the bonding of the moldable inner tray 36 to the skeletal structure 26. The moldable lingual side wall 38 of the moldable inner tray 36 is attached to the lingual side wall 28 of the U-shaped skeletal structure 26. The material for the moldable tray element 36 can be softened with the application of heat and thereby molded to the individual user's bite. The material can be a version of EVA or soft moldable and plasticized thermoplastic material, similar to other boil/bite mouth guards. The material should be FDA approved or meet internal mouth standards.

The moldable pad 34 is positioned in the slot 42 of the outer tray 18 and is attached to the lattice of reinforcing ribs 33 of the skeletal structure 26. The moldable pad 34 has a thickness so that it extends beyond the base 24 of the U-shaped outer tray 18. Again, the open structure of the lattice of reinforcing ribs 33 contributes to the bonding of the moldable pad 34 to the skeletal structure 26. The material for the continuous moldable pad 34 is similar to the material used for the moldable tray element 36 in that it can be heated and molded to the individual user's bite. While the moldable pad 34 is shown as a continuous wide strip, the moldable pad 34 can be implemented as a series of discrete pads, and the width of the moldable pad 34 can be reduced.

Figure 7:
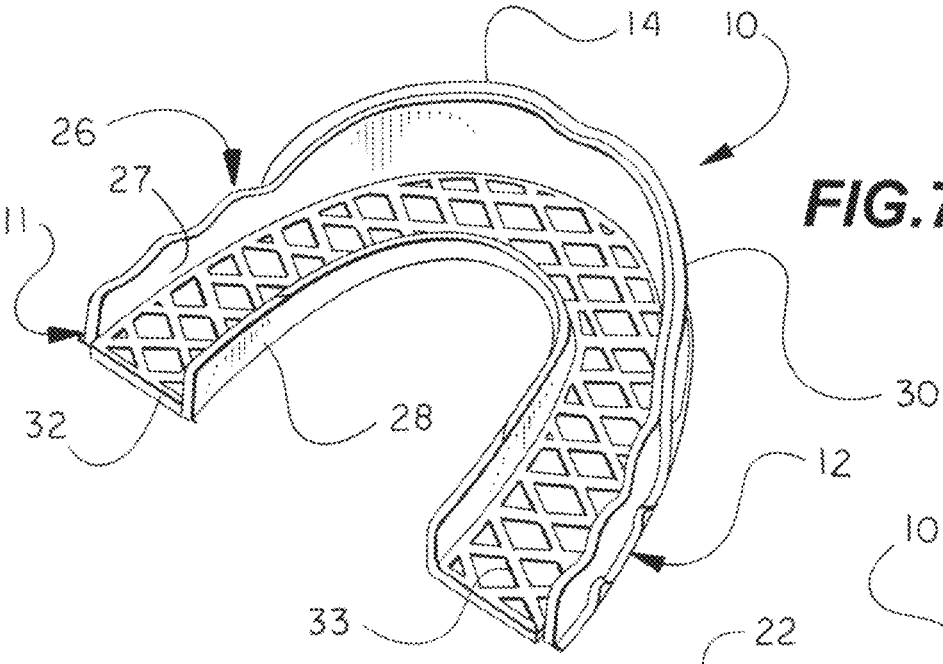
FIG. 7 is a top perspective view of an internal U-shaped skeletal portion including a lingual side wall and a labial side wall of the first embodiment of the mouth guard in accordance with the present invention.
Figure 9:
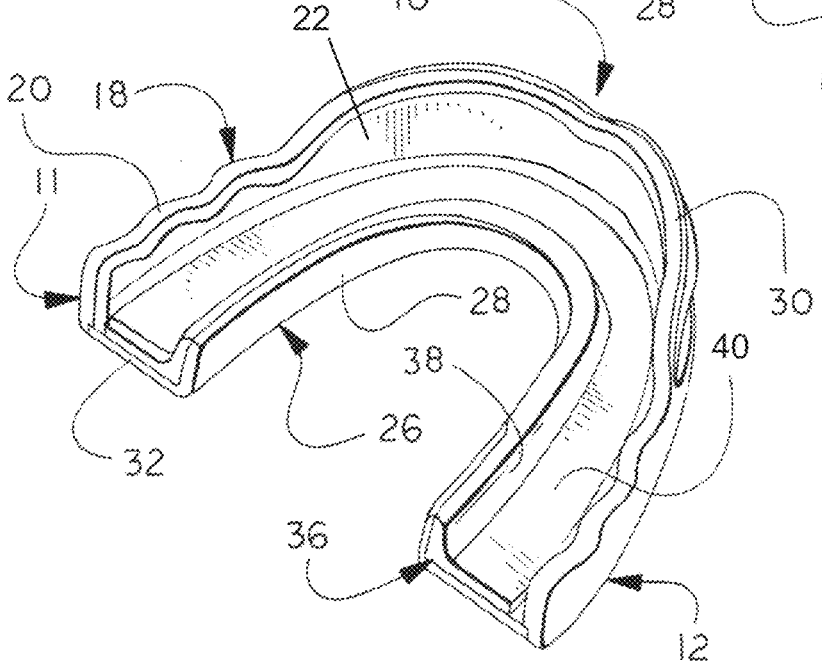
FIG. 9 is a top perspective view of the mouth guard including a moldable inner tray of the first embodiment of the mouth guard in accordance with the present invention.

FIGS. 7-9 illustrate the sequence of how the mouth guard 10 is constructed. In the first molding pass shown in FIG. 7, the U-shaped skeletal structure 26 with its lattice of reinforcing ribs 33 is formed. FIG. 8 illustrates the second molding pass in which the U-shaped outer tray 18 is formed around the U-shaped skeletal structure 26. FIG. 9 shows the third molding pass in which the moldable inner tray 36 and the moldable pad 34 are added to the mouth guard 10. As shown in FIG. 8, the slot 42 is left in the bottom of the U-shaped outer tray 18 so that when the moldable inner tray 36 and the moldable pad 34 are formed, the moldable inner tray 36 and the moldable pad 34 interlock through the lattice of reinforcing ribs 33 and thus hold all the layers together.

Figure 5:
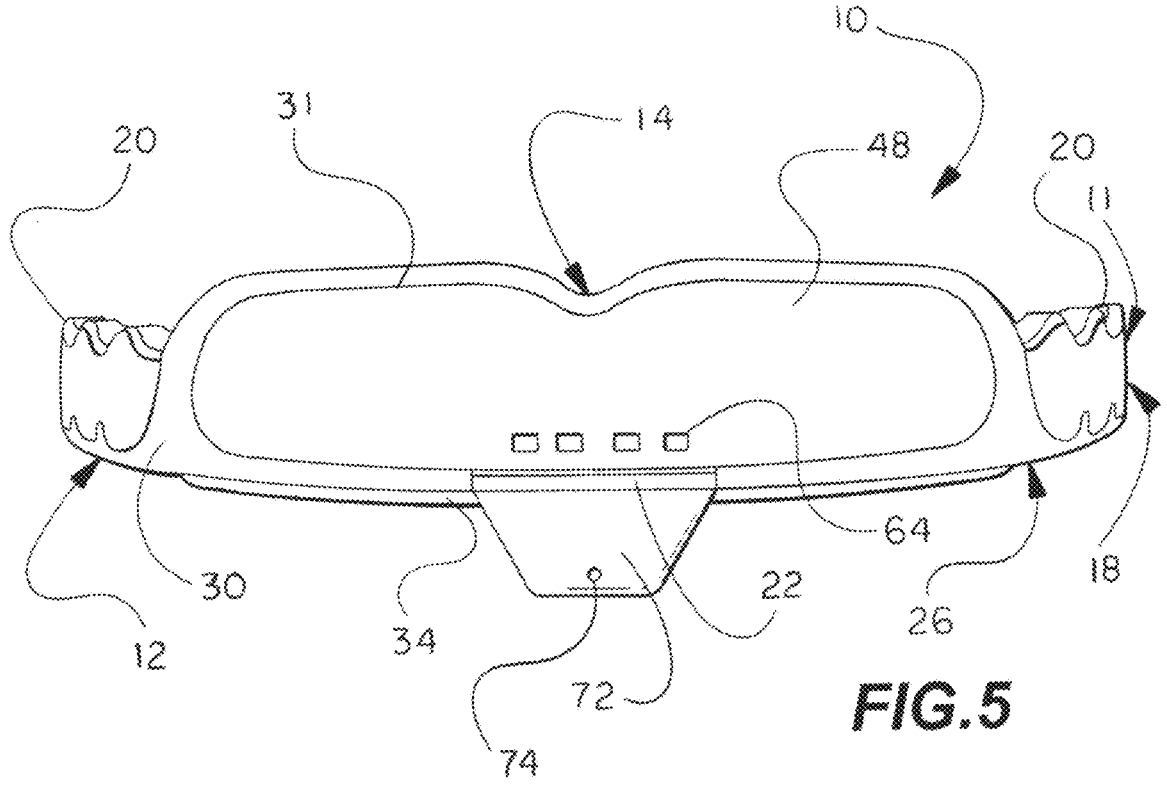
FIG. 5 is a front elevation view of the first embodiment of the mouth guard in accordance with the present invention.
Figure 6:
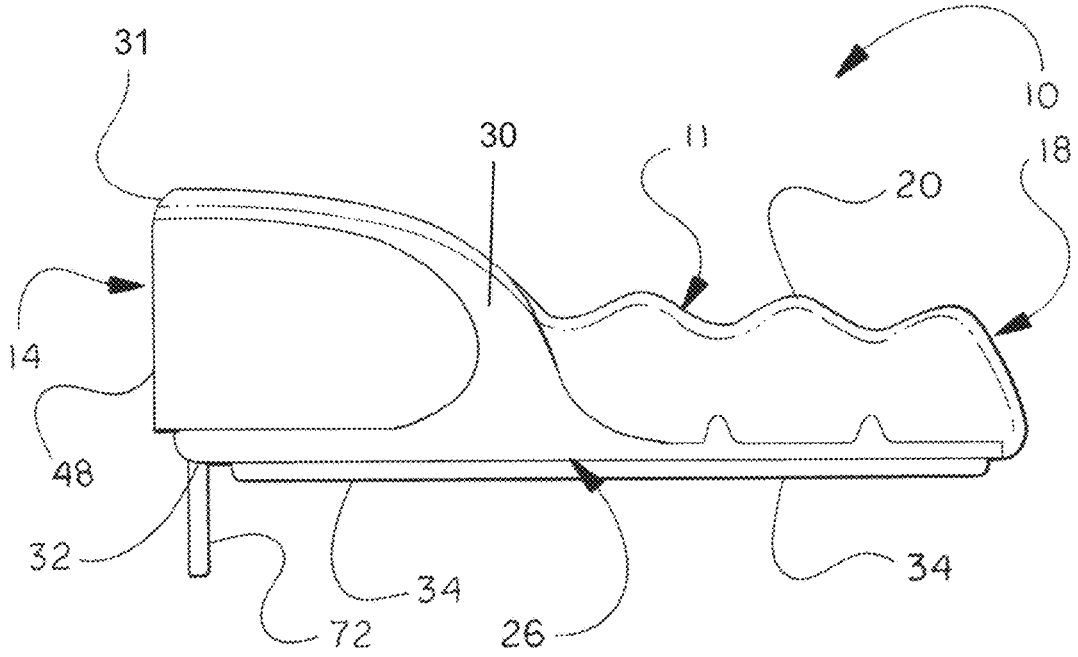
FIG. 6 is a side elevation view of the first embodiment of the mouth guard in accordance with the present invention.
Figure 22:
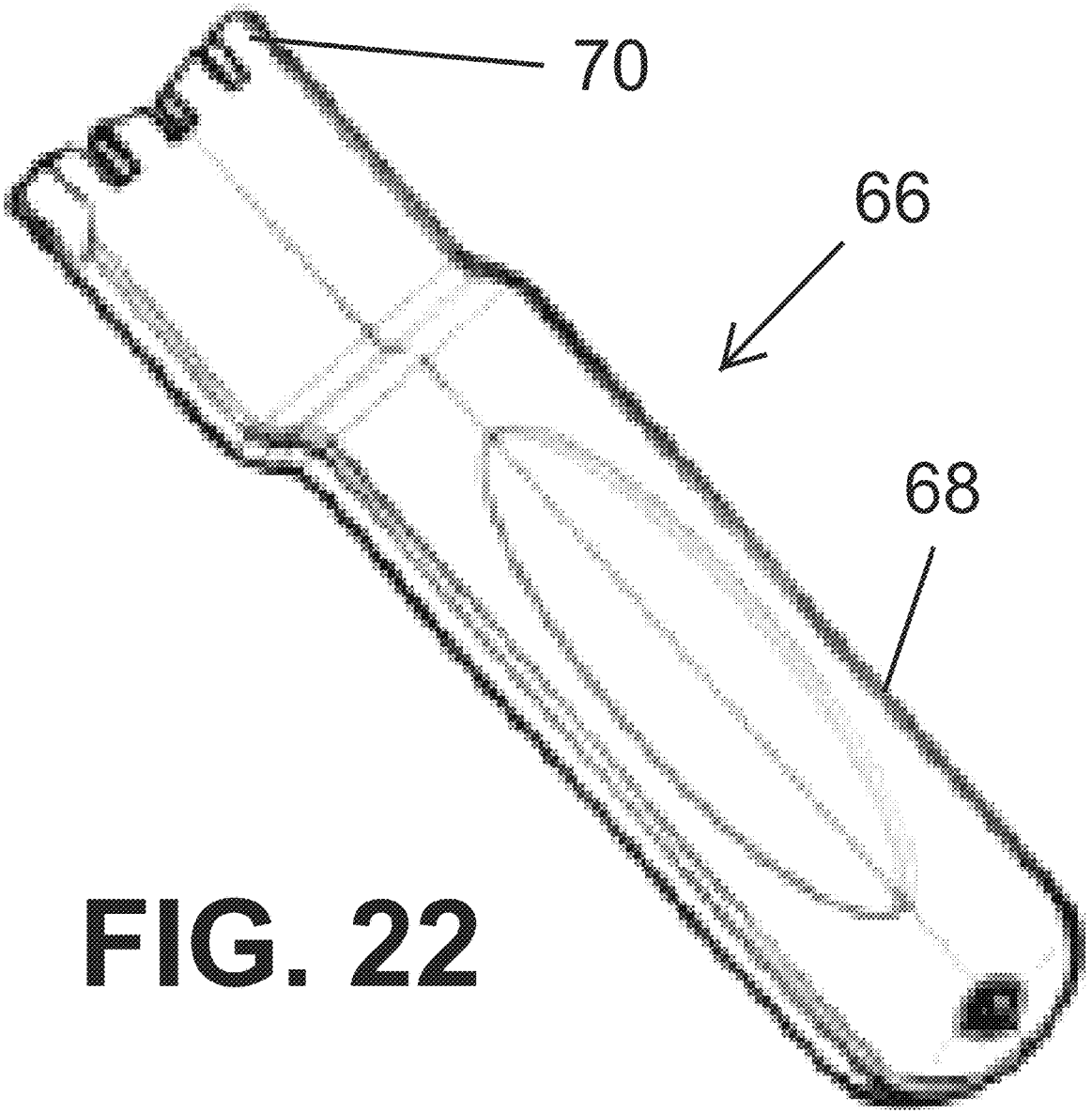
FIG. 22 is a perspective view of a first embodiment of a faceplate insertion and removal tool in accordance with the present invention.

As best seen in FIGS. 5 and 6, the front panel 30 of the skeletal structure 26 has a front panel recess 29 that accommodates the faceplate 48. The faceplate 48 comprises a flexible printable plastic material. Consequently, any design or image can be printed on the faceplate 48 thereby allowing the user to personalize the mouth guard 10 to reflect a team affiliation or other personal preference. Attachment of the faceplate 48 to the front panel 30 of the mouth guard 10 is described in greater detail below with respect to the various embodiments. With respect to the first embodiment, a recess edge 31 surrounds the front panel recess 29 of the front panel 30 and is instrumental in attaching the faceplate 48 to the front panel 30 of the skeletal structure 26. The front panel groove 35 is formed between the front panel recess 29 and the flexible front panel recess edge 31 (FIG. 25). In the embodiment shown in FIGS. 5 and 6, the recess edge 31 is soft and flexible and can be folded back from the front panel 30 to expand the open area of the recess 29. The recess 29 and the recess edge 31 together form the front panel groove 35 around the perimeter of the recess 29. The peripheral front panel groove 35 captures the edges of the faceplate 48 to hold the faceplate 48 within the front panel recess 29. The faceplate 48 in the embodiment shown in FIGS. 5 and 6 has openings 64. An insertion/removal tool 66 (FIG. 22) has a handle 68 and prongs 70 that match the openings 64 of the faceplate 48. By engaging the openings 64 in the faceplate 48, the insertion/removal tool 66 allows the user to flex the faceplate 48 so that the edges of the faceplate 48 can be inserted into the peripheral front panel groove 35 formed between the recess 29 and the flexible front panel recess edge 31. Similarly, the insertion/removal tool 66 can be used to engage the openings 64 to remove the faceplate 48 from the peripheral front panel groove 35 thereby allowing the user to change faceplates 48.

Figure 10:
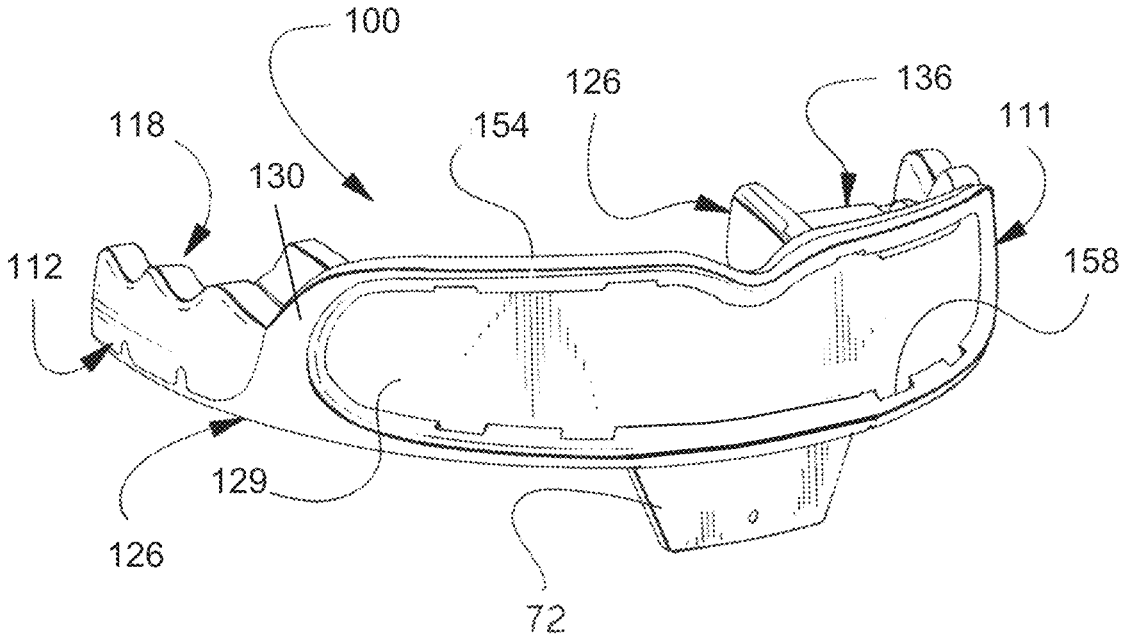
FIG. 10 is a front perspective view of a second embodiment of the mouth guard with the faceplate removed in accordance with the present invention.
Figure 11:
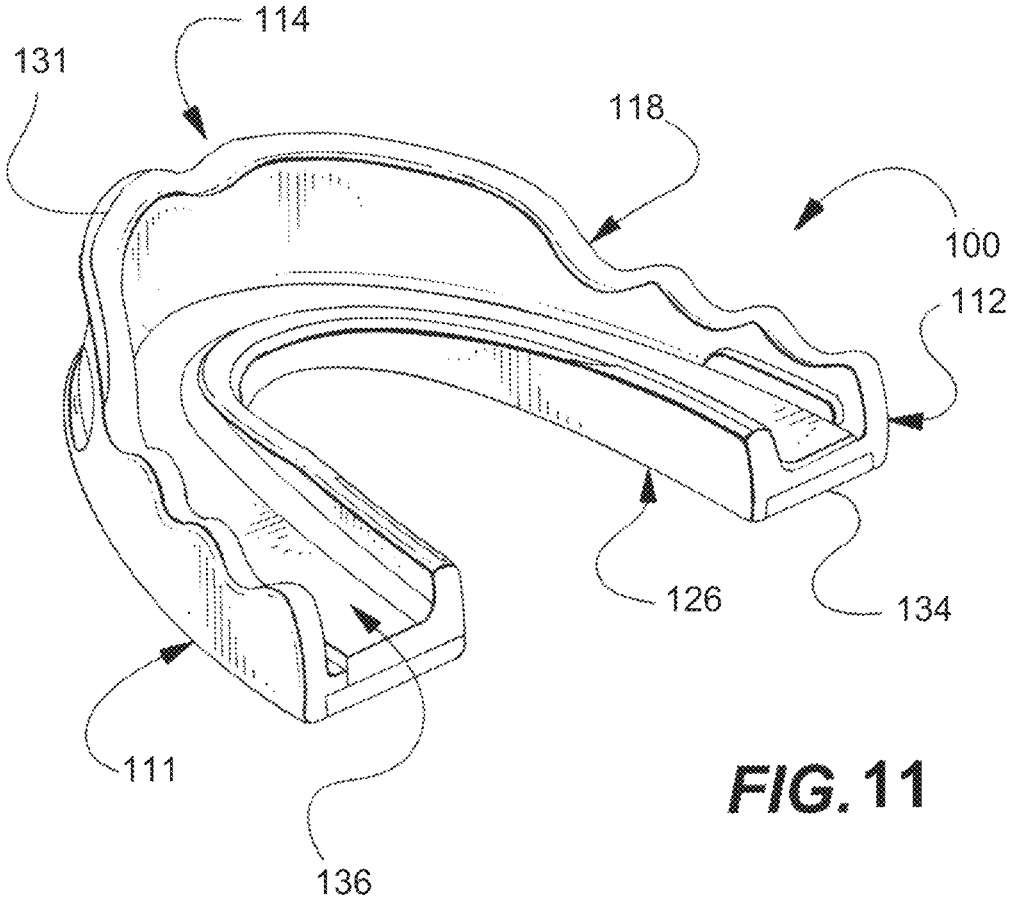
FIG. 11 is a back perspective top view of the second embodiment of the mouth guard in accordance with the present invention.
Figure 12:
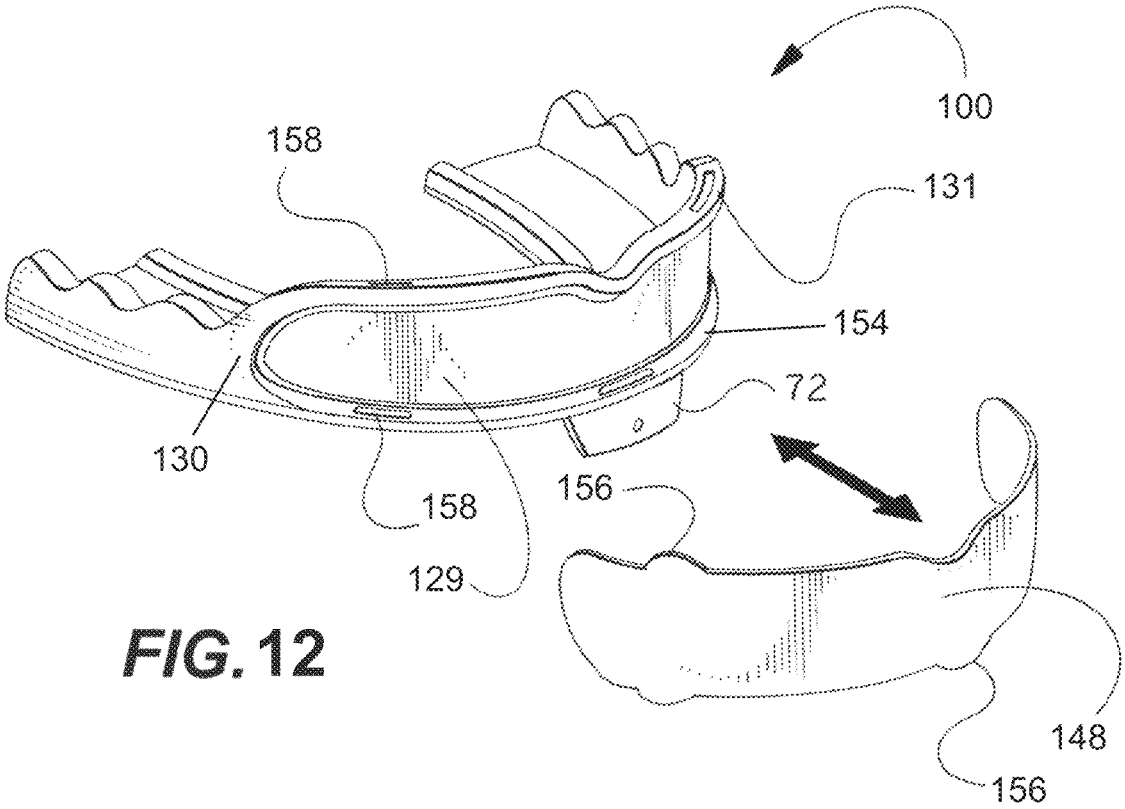
FIG. 12 is a front perspective view of the second embodiment of the mouth guard in accordance with the present invention.

A second embodiment of the mouth guard 10 in accordance with the present invention is illustrated by mouth guard 100 shown in FIGS. 10-12. The mouth guard 100 differs from mouth guard 10 of the first embodiment with respect to engagement between the faceplate 148 and the front panel 130. The mouth guard 100 has a front panel 130 with a front panel recess 129. The front panel recess 129 of the mouth guard 100 has a recess edge 131 with edge openings 158. A faceplate 148 has coplanar tabs 156 along the edge of the faceplate 148. The coplanar tabs 156 coincide with the edge openings 158. When the faceplate 148 is inserted into the recess 129 of the front panel 130, the coplanar tabs 156 engaging the edge openings 158 and hold the faceplate 148 in place in the recess 129. The arrangement of the coplanar tabs 156 and the edge holes 158 allow the faceplate 148 to be inserted and removed in order to change the look of the mouth guard 100.

Figure 13:
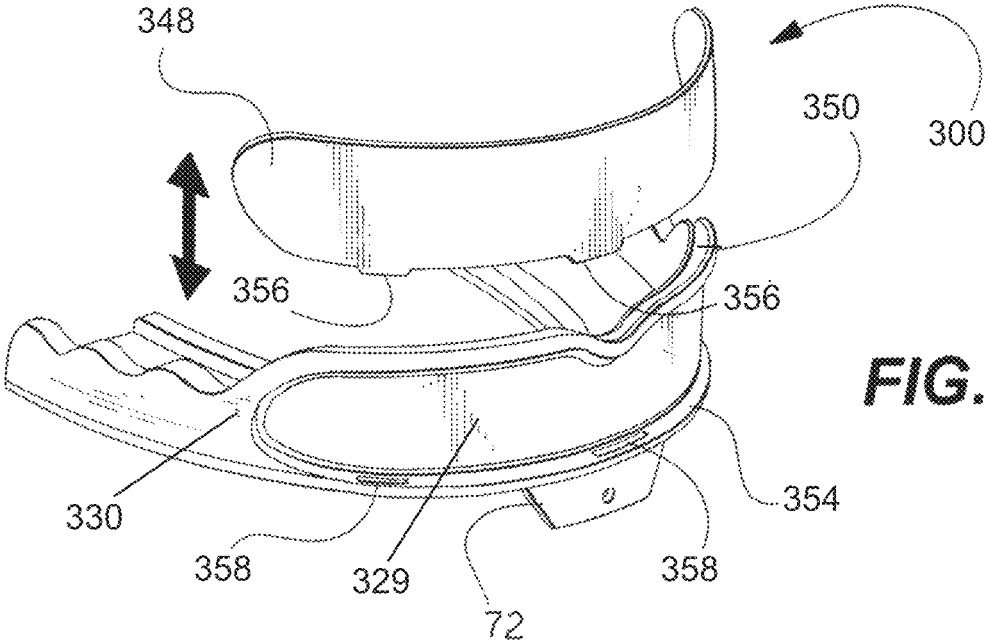
FIG. 13 is a front perspective view of a third embodiment of the mouth guard in accordance with the present invention.

A third embodiment of the mouth guard 10 in accordance with the present invention is illustrated by mouth guard 300 shown in FIG. 13. The mouth guard 300 has a front panel 330 with a front panel recess 329. The front panel recess 329 of the mouth guard 300 has a slotted recess edge 354. The slotted recess edge 354 has a top horizontal slot 350 created in the upper side of the slotted recess edge 354. The slotted recess edge 354 also has edge openings 358 in the lower side of the slotted recess edge 354. A faceplate 348 has coplanar tabs 356 along its lower edge. The faceplate 348 is inserted into the horizontal slot 350, and the coplanar tabs 356 engage the edge openings 358 in the lower side of the slotted recessed edge 354. The faceplate 348 can be easily inserted by sliding the faceplate 348 through the slot 350 into engagement with the edge openings 358. The faceplate 348 is removed by reversing the insertion procedure.

Figure 14:
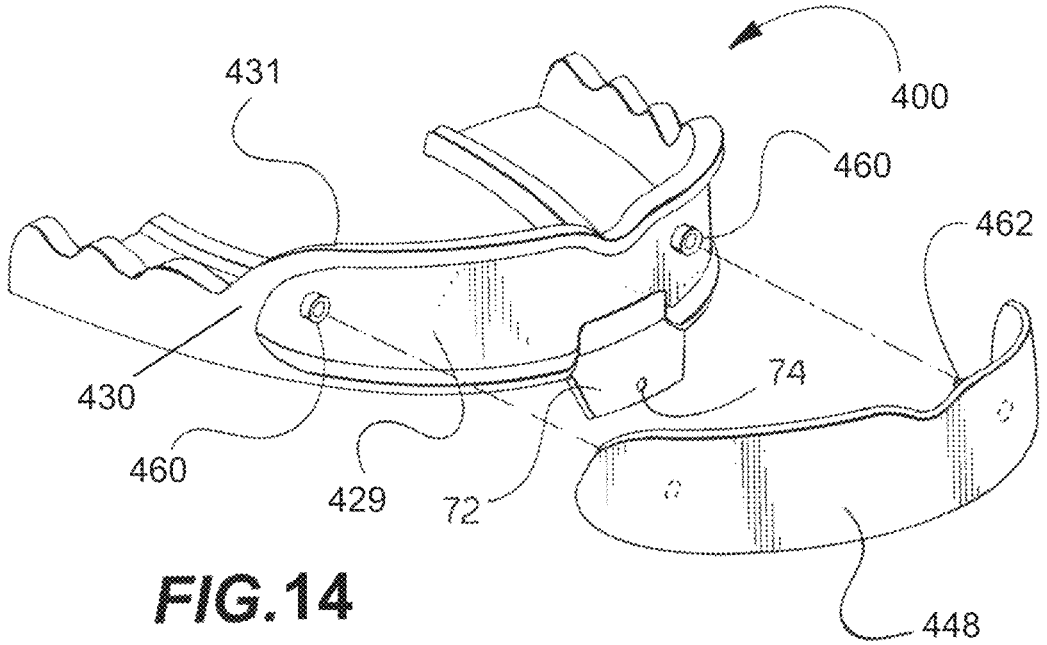
FIG. 14 is a front perspective view of a fourth embodiment of the mouth guard in accordance with the present invention.
Figure 15:
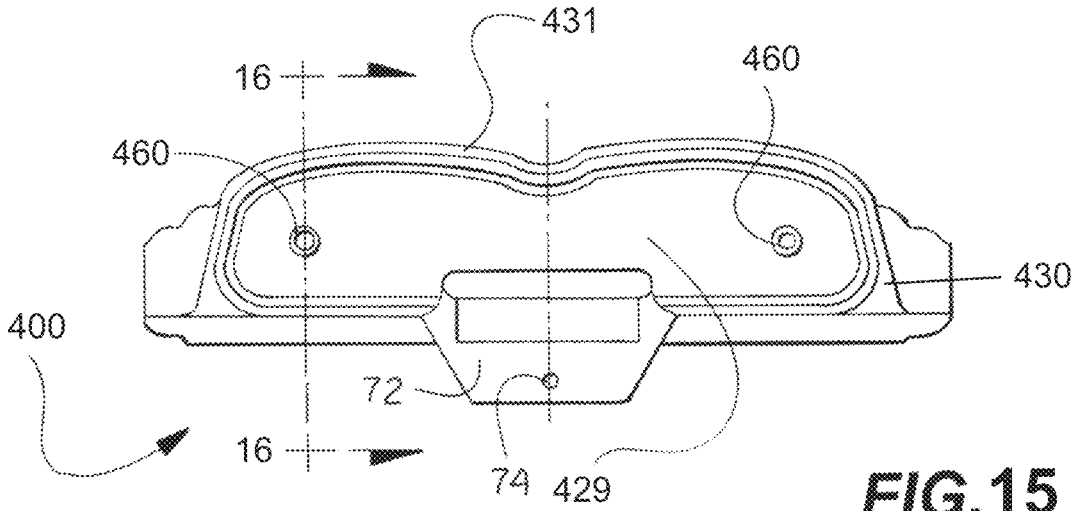
FIG. 15 is a front elevation view of the fourth embodiment of the mouth guard in accordance with the present invention.
Figure 16:
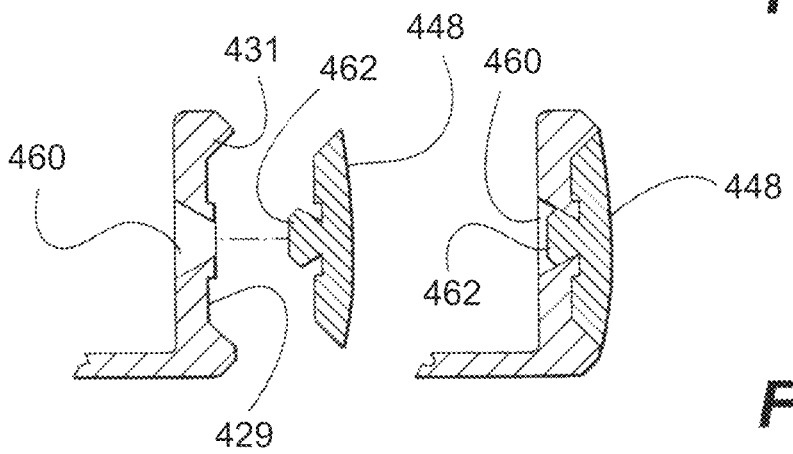
FIG. 16 is a detailed side section view as seen along the line 16-16 of the fourth embodiment of the mouth guard in accordance with the present invention.
Figure 18:
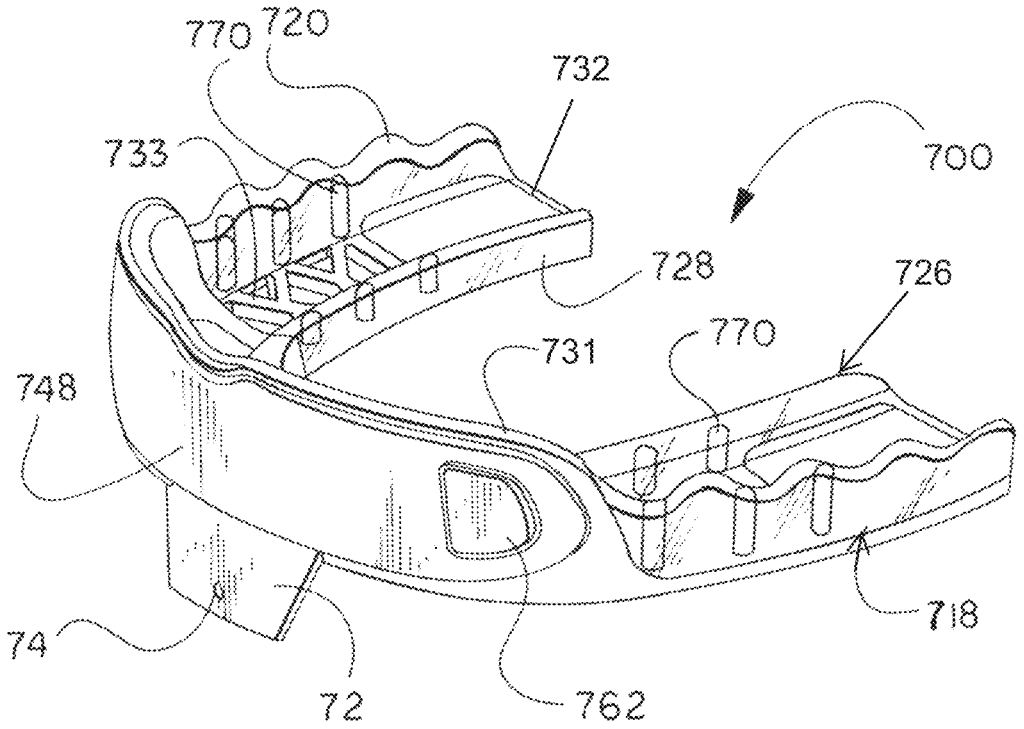
FIG. 18 is a front perspective view of a sixth embodiment with transparent portions showing internal detail of the mouth guard and with portions of the moldable inner tray removed for the purposes of illustration in accordance with the present invention.
Figure 19:
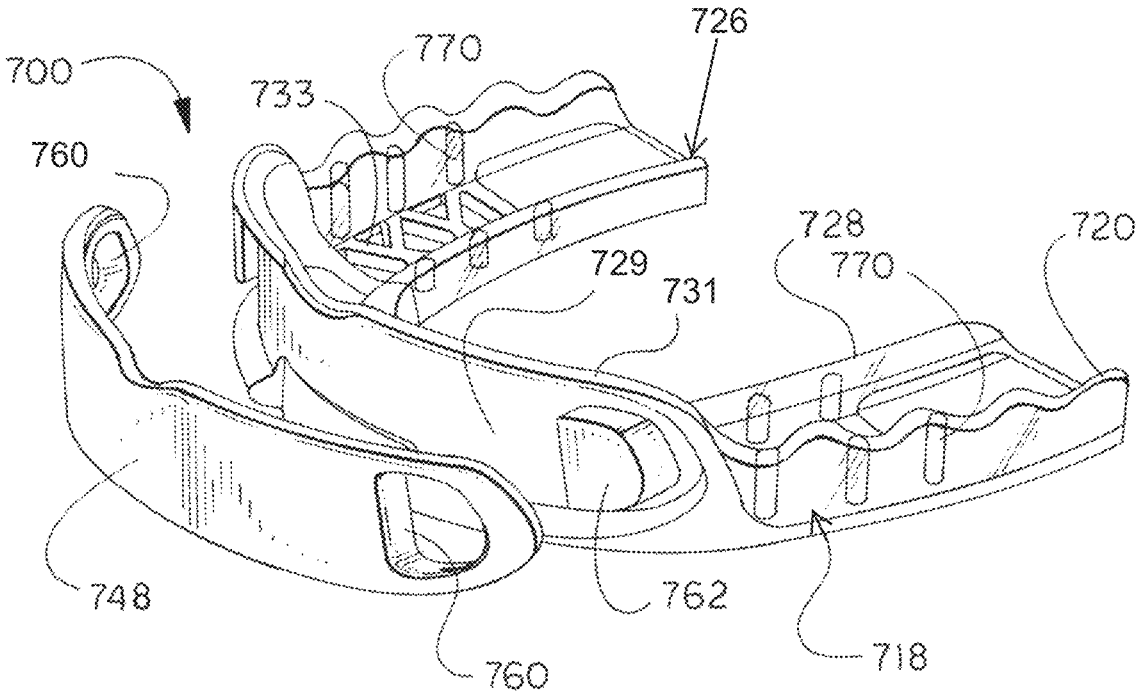
FIG. 19 is a front perspective view of the sixth embodiment of the mouth guard with the faceplate removed and with portions of the moldable inner tray removed for the purposes of illustration in accordance with the present invention.
Figure 20:
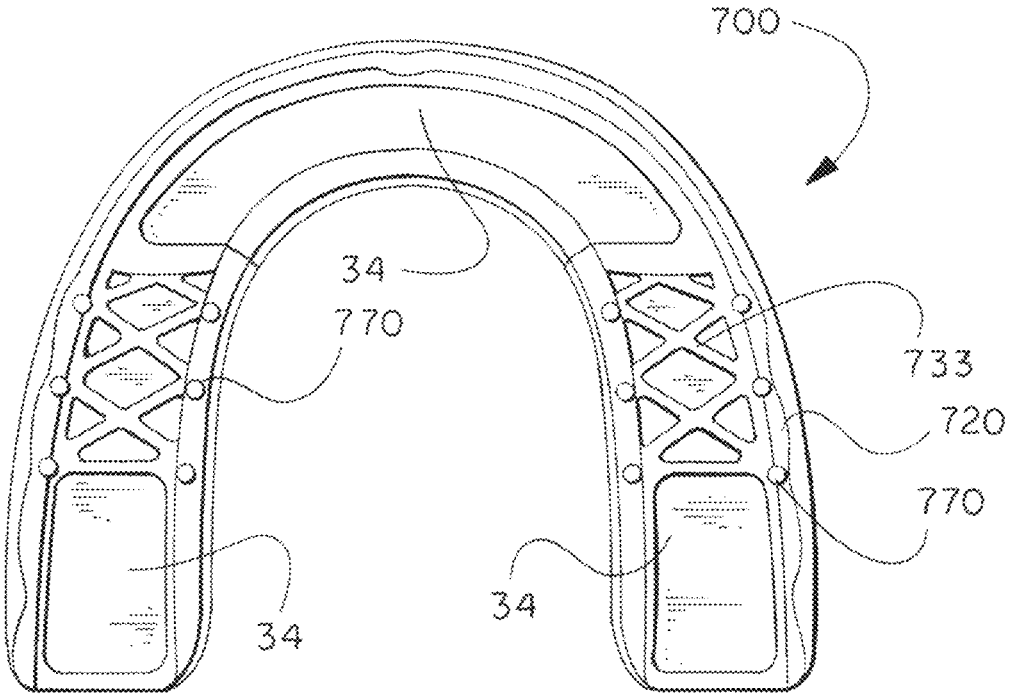
FIG. 20 is a top plan view of the sixth embodiment of the mouth guard with portions of the moldable inner tray removed for the purposes of illustration in accordance with the present invention.
Figure 21:
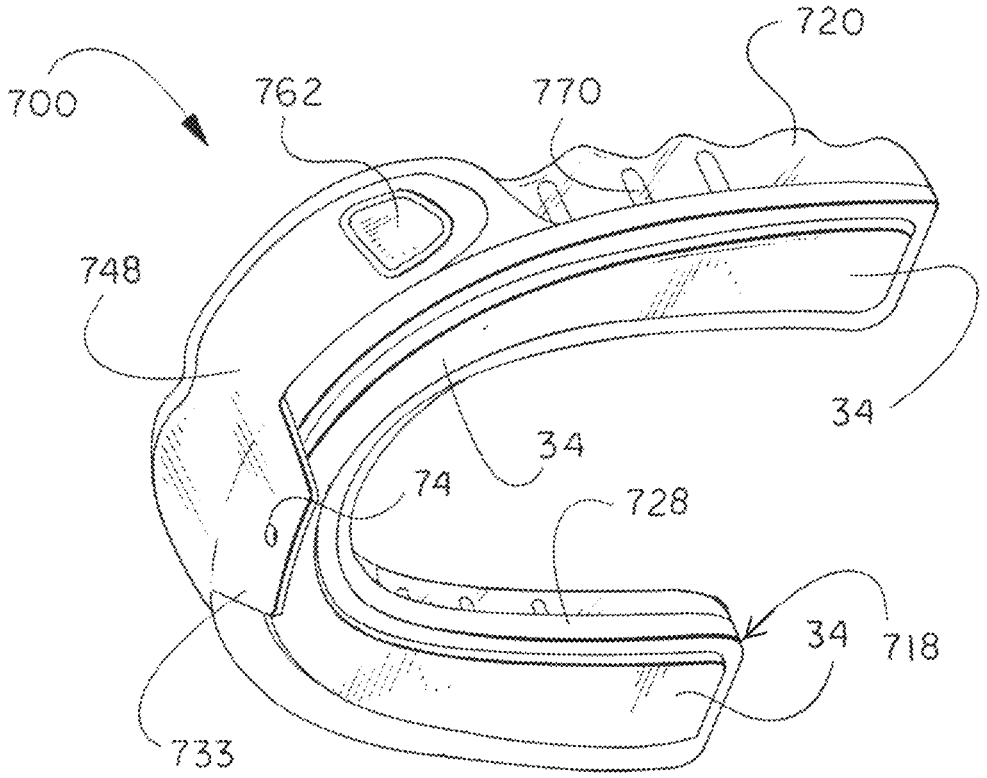
FIG. 21 is a bottom perspective view of the sixth embodiment of the mouth guard in accordance with the present invention.

A fourth embodiment of the mouth guard 10 in accordance with the present invention is illustrated by mouth guard 400 shown in FIGS. 14-16. The mouth guard 400 has a front panel 430 with a front panel recess 429. The front panel recess 429 of the mouth guard 400 has a front panel recess edge 431. The recess 429 has face holes 460 at either side of the recess 429. A faceplate 448 has posts 462 that extend toward the recess 429. The faceplate 448 is held in the recess 429 by the posts 462 friction only engaging the face holes 460 as shown in FIG. 16.

A fifth embodiment of the mouth guard 10 in accordance with the present invention is illustrated by mouth guard 500 shown in FIGS. 17A-D. The mouth guard 500 has a front panel 530 with a front panel recess 529. The front panel recess 529 of the mouth guard 500 has a front panel recess edge 531. The mouth guard 500 has posts 562 in the recess 529 and face holes 560 in faceplate 548. The faceplate 548 is held in place in the recess 529 when the face holes 560 frictionally engage the posts 562.

A sixth embodiment of the mouth guard 10 in accordance with the present invention is illustrated by mouth guard 700 shown in FIGS. 18-21. The mouth guard 700 comprises a skeletal structure 726 including a base 732 with a lattice of reinforcing ribs 733, and a lingual side wall 728. A series of posts 770 extend upwardly on the labial side of the base 732 and on the lingual side of the base 732. A U-shaped outer tray 718 is then cast around the posts 776 and has a labial sidewall 720. The mouth guard 700 has a faceplate 748 is held in a front panel recess 729 by posts 762 protruding from the recess 729 and holes 760 at the ends of the faceplate 748. The mouth guard 700 is in all other respects the same as the previously described with respect to the first embodiment.

Figure 23:
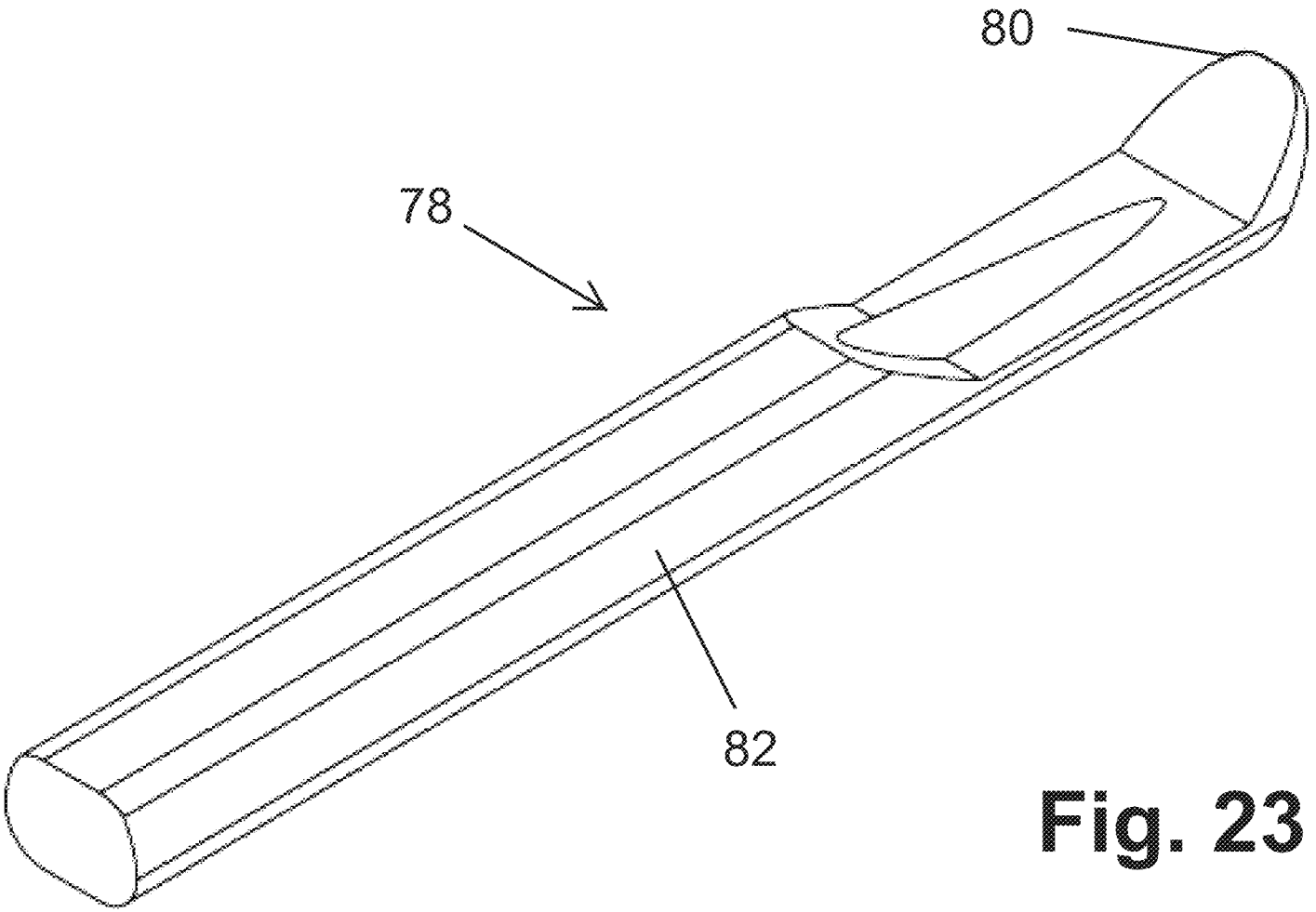
FIG. 23 is a perspective view of a second embodiment of a faceplate insertion and removal tool in accordance with the present invention.
Figure 24:
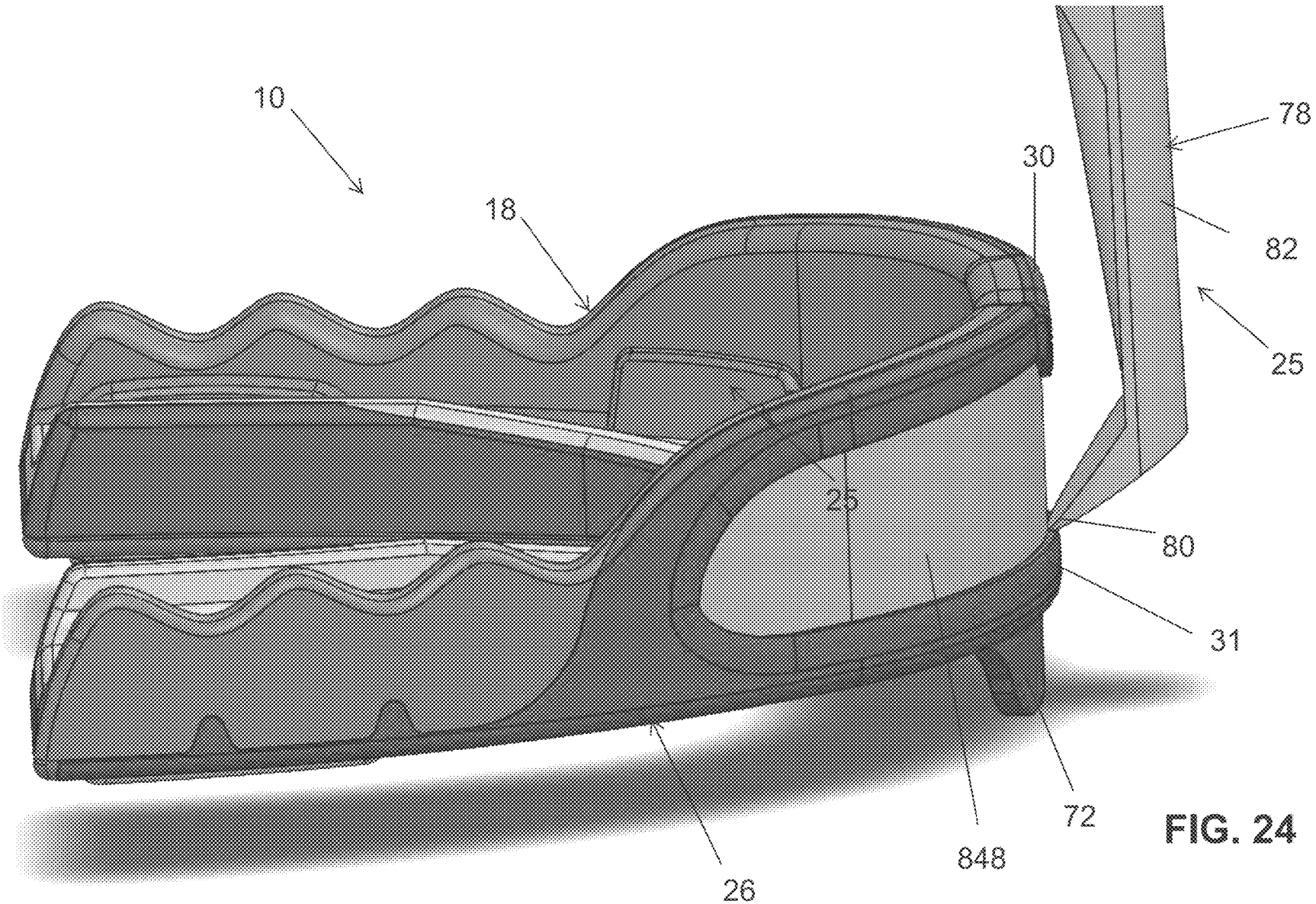
FIG. 24 is a perspective view of the first embodiment of a mouth guard without the removal openings in the faceplate in accordance with the present invention.

Turning to FIGS. 23-25, the first embodiment of the mouth guard 10 is shown in FIGS. 24 and 25 except that the faceplate 848 differs from faceplate 48 in that the faceplate 848 does not have the removal openings 64 of faceplate 48 (FIG. 5). Instead, in order to insert and remove the faceplate 848 from the flexible front panel recess edge 31, an insertion tool 78 is utilized. The insertion tool 78 has a wedge-shaped end and a gripping handle 82. As best shown in FIG. 25, the wedge-shaped end 80 of the insertion tool 78 is inserted between the faceplate 848 and the flexible front panel recess edge 31. Once the wedge-shaped end 80 of the insertion tool 78 engages the lower edge of the faceplate 848, the handle 82 is rotated clockwise as shown in FIG. 25 to urge the flexible front panel recess edge 31 downward and pull the lower edge of the faceplate 848 from engagement with the flexible front panel recess edge 31. In order to insert the faceplate 848, the process is reversed with the wedge-shaped end 80 used to wedge the faceplate 848 into engagement with front panel groove 35 formed between the front panel recess 29 and the flexible front panel recess edge 31.

While this invention has been described with reference to preferred embodiments thereof, it is to be understood that variations and modifications can be affected within the spirit and scope of the invention as described herein and as described in the appended claims.

I claim:

1. A U-shaped mouth guard with for engaging the teeth of a user, the mouth guard comprising:

a. a U-shaped molded skeletal structure having a skeletal base formed of a lattice of reinforcing ribs including:
   i. a skeletal lingual side wall attached to the skeletal base;
   ii. a skeletal labial side wall attached to the skeletal base; and
   iii. a skeletal front panel attached to the skeletal base;

b. a U-shaped outer tray attached to the reinforcing ribs of the skeletal structure including:
   i. an outer tray labial side wall attached to the skeletal labial side wall;
   ii. an outer tray front portion attached to the front panel of the skeletal structure; and
   iii. an outer tray base attached to an underside of the lattice of reinforcing ribs; and having a slot for exposing the lattice of reinforcing ribs;

c. a moldable U-shaped inner tray attached to the reinforcing ribs of the skeletal structure including:
   i. a inner tray base attached to an upper side of the lattice of reinforcing ribs; and
   ii. an inner tray lingual side wall attached to an inner side of the skeletal lingual side wall; and d. a moldable U-shaped bottom pad attached to the underside of the lattice of reinforcing ribs.

2. The U-shaped mouth guard of claim 1, wherein the U-shaped mouth guard further comprises the moldable U-shaped bottom pad is positioned in the slot of the base of the outer tray and attached to the underside of the lattice of reinforcing ribs.

3. The mouth guard of claim 1 wherein a pair of rear wedges each located on an inside surface of the outer tray labial side wall and a pair of forward wedges each located on the inside surface of the outer tray labial side wall adjacent the front panel.

* * * * *